US008969280B2

(12) United States Patent
Lock et al.

(10) Patent No.: US 8,969,280 B2
(45) Date of Patent: Mar. 3, 2015

(54) VISUALLY CONTRASTING AESTHETIC PARTICLES HAVING INCREASED WATER SOLUBILITY, PARTICULARLY USEFUL FOR COMBINATION WITH POWERED OR GRANULAR COMPOSITIONS

(71) Applicant: The Procter & Gamble Company, Cincinnati, OH (US)

(72) Inventors: Richard Lock, Chester (GB); Michael Pickstock, Norwich (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/912,197

(22) Filed: Jun. 7, 2013

(65) Prior Publication Data

US 2013/0345108 A1 Dec. 26, 2013

Related U.S. Application Data

(60) Provisional application No. 61/657,141, filed on Jun. 8, 2012, provisional application No. 61/676,265, filed on Jul. 26, 2012.

(51) Int. Cl.

| | |
|---|---|
| ***C11D 17/06*** | (2006.01) |
| ***C11D 1/04*** | (2006.01) |
| ***C11D 3/12*** | (2006.01) |
| ***C11D 3/37*** | (2006.01) |
| ***C11D 3/386*** | (2006.01) |

(52) U.S. Cl.

CPC ..... *C11D 17/065* (2013.01)
USPC ..... 510/276; 510/299; 510/302; 510/320; 510/324; 510/334; 510/351; 510/352; 510/357; 510/349; 510/438; 510/507

(58) Field of Classification Search

USPC ..... 510/276, 299, 302, 320, 324, 334, 351, 510/352, 357, 349, 438, 507

See application file for complete search history.

(56) References Cited

U.S. PATENT DOCUMENTS

| | | | | | |
|---|---|---|---|---|---|
| 4,062,647 | A | * | 12/1977 | Storm et al. | 8/137 |
| 4,196,104 | A | * | 4/1980 | Oguagha | 510/330 |
| 4,292,035 | A | * | 9/1981 | Battrell | 8/137 |
| 4,632,768 | A | * | 12/1986 | Atkinson | 510/308 |
| 4,764,292 | A | * | 8/1988 | Sepulveda et al. | 510/330 |
| 4,861,502 | A | * | 8/1989 | Caswell | 510/299 |
| 4,992,193 | A | | 2/1991 | Evans | |
| 5,756,440 | A | | 5/1998 | Watanabe et al. | |
| 2004/0110652 | A1 | | 6/2004 | Hafkamp et al. | |
| 2005/0177956 | A1 | * | 8/2005 | Wang | 8/102 |
| 2009/0082245 | A1 | * | 3/2009 | Smith et al. | 510/336 |

FOREIGN PATENT DOCUMENTS

| | | | |
|---|---|---|---|
| EP | 0 430 328 | A2 | 6/1991 |
| GB | 2358403 | B | 9/2004 |
| GB | 2358404 | B | 9/2004 |
| WO | WO 2006/079416 | A1 | 8/2006 |
| WO | WO 2009/047124 | A1 | 4/2009 |
| WO | WO 2009/047127 | A1 | 4/2009 |
| WO | WO 2010/024468 | A1 * | 3/2010 |
| WO | WO 2010/076388 | A1 * | 7/2010 |

OTHER PUBLICATIONS

PCT Search Report; 12 Pages, PCT/US2013/044629 mailed on Jan. 15, 2014.

* cited by examiner

*Primary Examiner* — Lorna M Douyon

(74) *Attorney, Agent, or Firm* — John T. Dipre; Steven W. Miller

(57) ABSTRACT

The present invention is directed to visually contrasting aesthetic particles having increased water solubility, particularly useful for combination with granular laundry detergent composition.

12 Claims, 1 Drawing Sheet

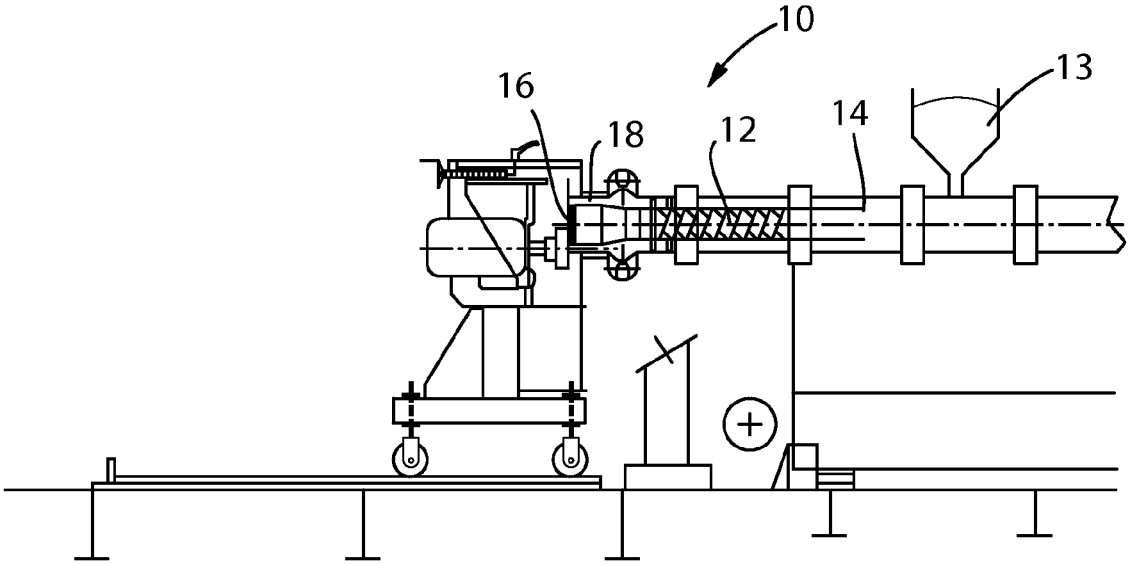
10
16
18
12
14
13

VISUALLY CONTRASTING AESTHETIC PARTICLES HAVING INCREASED WATER SOLUBILITY, PARTICULARLY USEFUL FOR COMBINATION WITH POWERED OR GRANULAR COMPOSITIONS

CROSS-REFERENCE TO RELATED APPLICATIONS

The benefit under 35 U.S.C. §119(e) of U.S. Provisional Patent Application Nos. 61/657,141 filed Jun. 8, 2012, and U.S. Provisional Patent Application No. 61/676,265 filed Jul. 26, 2012, the disclosure of which are incorporated herein by reference in their entireties, is hereby claimed.

FIELD OF THE INVENTION

The present invention relates to visually contrasting aesthetic particles, also referred to as visual cues, for combining with powdered or granular products, such as laundry detergent compositions, for use in laundering fabrics; or for use in adding color to water, such as in a toilet bowl.

BACKGROUND AND PRIOR ART

It is well known to include visually contrasting particles, in powdered or granular laundry detergent compositions. The visually contrasting particles may be included as a cue to the consumer, to indicate the presence of some specific quality or ingredient, or may simply be present to give the product an attractive appearance.

GB 2,358,403B discloses colored lamellar polymeric particles that are cut from a planar film in any desired shape, such as numerals, letters of the alphabet, circles, sun, moon and star shapes. Cutting such shapes from a planar film leaves a high percentage of waste film material for recycling. Such recycling of film material is costly and inefficient.

Other patents, e.g., WO 2009/047124 A1, disclose manufacturing lamellar particles by cutting identical shapes from a film, without waste material between the cut shapes, such that the cut shapes can be tiled. Other patents describe additives in the visually contrasting particles, such as a fluorescent dyes (GB 2,358,404 B) or a perfume (WO 2009/047127 A1).

One of the significant problems with the inclusion of visually contrasting aesthetic particles in laundry detergent compositions is that the particles may not completely solubilize during the wash cycle of an automatic washing machine. Insoluble residue from the contrasting particles can remain on the washed fabrics and create an impression of the fabrics not being clean, or the residue could look like specific soiled areas. One published application that describes this problem is WO 2006/079416, claiming visually contrasting aesthetic particles that leave less than 10 wt % insoluble residues. Materials leaving less than 10 wt. % insoluble residues were gum Arabic, casein, hydroxypropyl methyl cellulose, and sodium carboxymethyl cellulase.

Besides being sufficiently soluble, the composition of the aesthetic particles should allow for manufacturing particles having a number of different sizes, shapes and colors in a variety of designs, such as rings, needles, stars and other shapes that will be evocative in the consumer's mind of the finished product.

SUMMARY

In accordance with the compositions, visually contrasting aesthetic particles and methods of manufacturing described herein, a particulate laundry detergent composition includes a major proportion of white or light-colored detergent of visually contrasting aesthetic particles that leave 5% or less undissolved residue when subjected to a dissolution test, described herein.

We have found that a combination of a fatty acid, or blend of fatty acids, together with and two different types of bentonite gives a surprisingly higher solubility than either of the individual bentonite products at the same composition level.

Example 1

| Composition | | | | Testing |
|---|---|---|---|---|
| Oleate fatty acid | QPC | QPN | APV Running pressure (PSI) | Solubility (% residue left) |
| 100 | 0 | 0 | 800 | 27.23 |
| 60 | 40 | 0 | 480 | 25.36 |
| 60 | 0 | 40 | 510 | 6.85 |
| 60 | 20 | 20 | 380 | 4.35 |

An APV extruder, run at 300 rpm with a fed rate of ca. 23 g/min and extruder hole diameter of 0.8 mm, was used to run the samples described above. The feedstock for run was a fatty acid or blend of fatty acids with either a single clay (QPC or QPN) or the fatty acid with an equal blend of the two clays. Surprisingly, we found that when the combination of a sodium active clay (QPN) and an unactivated, calcium clay (QPC) were combined we got the lowest residual material remaining after the dissolution test was completed. The fact that a combination of an activated and nonactivated clay would give the lowest solubility is an unexpected result.

Dissolution Test Method

Set the temperature controller on a Tergotometer to 15° C. and fill each of the vessels with 1000 ml of cold medium hardness water (around 10 grains per gallon). Set the stiffing speed to 200 rpm. When the water has reached the correct temperature, add 3.5 g of laundry detergent immediately followed by addition of 1 g of aesthetic particles. Record the time that it takes the aesthetic particles to completely dissolve and if it takes more than 15 minutes, stop stirring at that point. Carefully pour the wash liquid and any undissolved material onto a 150 μm sieve and rinse briefly with di-ionized water, then carefully transfer the liquid and any undissolved material to a Buchner funnel where the product is filtered through a dried and pre-weighed Whatman® Type 4 filter paper. The filter paper is then dried at 105° C. and weighed to determine the wt. % of the residual aesthetics particles.

BRIEF DESCRIPTION OF THE DRAWINGS

FIG. 1 is a schematic drawing of an extruder assembly.

DETAILED DESCRIPTION

Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

The Visually Contrasting Aesthetic Particles

The detergent compositions of the invention contain visually contrasting aesthetic particles that may or may not contain detergent-functional ingredients in addition to an oleate soap and a combination of a sodium smectite clay and a calcium smectite clay. For example, the sodium smectite clay can be sodium bentonite and the calcium smectite clay can be calcium bentonite.

The visually contrasting aesthetic particles also provide excellent visual contrast, in color, shape and size, to the bulk of the detergent composition, so that visual impact is maximized. Because detergent particles are irregularly shaped, the visually contrasting aesthetic particles are preferably regular in shape. Because detergent particles have a relatively broad particle size distribution, the visually contrasting bodies are preferably uniform in size.

They may, for example, all be of identical size and shape, but that is not essential. More than one size or shape may be present but, if so, these are preferably discrete and clearly defined rather than forming a continuum. The visually contrasting bodies are preferably formed of brightly colored material, which may, if desired, be fluorescent. Advantageously, the material is highly reflective (shiny). Not all bodies need be the same color.

As previously indicated, the visually contrasting aesthetic particles are preferably regular in shape. They may suitably possess a relatively high degree of symmetry. However, some aesthetically pleasing shapes may not be highly symmetrical.

According to one preferred embodiment of the invention, the visually contrasting aesthetic particles are of colored combination of an oleate surfactant, sodium montmorillonite clay and calcium montmorillonite clay. According to an embodiment, the visually contrasting aesthetic particles include sodium oleate soap, sodium bentonite (activated calcium), and calcium bentonite. In any of the embodiments herein, the visually contrasting aesthetic particles can include a colorant, such as a dye or a pigment.

The aesthetic particles may suitably have symmetrical and regular shapes, such as circles, squares, triangles, and stars. All aesthetic particles may be of the same shape and color, or different shapes and colors may be used together. The aesthetic particles may be of identical size, or of several different, but discrete, sizes.

As an alternative to the use of identical shapes, matched sets of shapes may be used, for example, geometrical shapes (triangles, squares, pentagons, hexagons), numerals, letters of the alphabet, heavenly bodies (sun, moon, stars). Congruent sets having the same shape but different sizes may also be used. Each set may have its own color.

The visually contrasting aesthetic particles need be present only at very low concentrations, for example, 0.02 to 1 wt %, preferably from 0.05 to 0.5 wt %, to make a significant visual impact, or may be included in the detergent composition in an amount up to about 3 wt %.

The following weight percentages of components in the aesthetic particles are based on the finished particles, dry (0% water) basis. The sodium smectite clay may be provided in the aesthetic particles, for example, in a range of about 10 wt % to about 70 wt %, about 12 wt. % to about 65 wt. %, about 10 wt. % to about 45 wt %, about 15 wt % to about 30 wt %, about 10 wt. % to about 40 wt %, or about 15 wt % to about 25 wt %. Other suitable amounts include, for example, about 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, and 70 wt %. For example, the sodium smectite clay can be sodium montmorillonite clay and/or sodium bentonite clay and be provided in the foregoing amounts.

The calcium smectite clay may be provided in the aesthetic particles, for example, in a range about 10 wt % to about 70 wt %, about 12 wt. % to about 65 wt. %, about 10 wt. % to about 45 wt %, about 15 wt % to about 30 wt %, about 10 wt. % to about 40 wt %, or about 15 wt % to about 25 wt %. Other suitable amounts include, for example, about 10, 11, 12, 13, 14, 15, 16, 17, 18, 19, 20, 21, 22, 23, 24, 25, 26, 27, 28, 29, 30, 32, 34, 36, 38, 40, 42, 44, 46, 48, 50, 52, 54, 56, 58, 60, 62, 64, 66, 68, and 70 wt %. For example, the calcium smectite clay can be calcium montmorillonite clay and/or calcium bentonite clay and be provided in the foregoing amounts.

The fatty acid can be provided, for example, in a range of about 10 wt % to about 70 wt %, about 20 wt % to about 65 wt %, about 35 wt % to about 70 wt %, about 55 wt % to about 65 wt %, or about 50 wt % to about 70 wt %. Other suitable amounts include, for example, about 10, 12, 13, 14, 15, 16, 17, 18, 19, 20, 21, 22, 23, 24, 25, 26, 27, 28, 29, 30, 32, 34, 36, 38, 40, 42, 44, 46, 48, 50, 51, 52, 53, 54, 55, 56, 57, 58, 59, 60, 61, 62, 63, 64, 65, 66, 67, 68, 69, and 70 wt %.

The aesthetic particles can also include a colorant, such as a dye or a pigment. The aesthetic particles can include one or more different colorants. The total amount of colorant included in the aesthetic particles can be, for example, in a range of about 0.001 wt % to about 5 wt %, about 0.01 wt % to about 5 wt %, about 0.05 wt % to about 4 wt %, about 0.07 wt %, to about 3 wt %, about 0.1 wt. % to about 2 wt %, about 0.5 wt % to about 2.5 wt %, about 1 wt. % to about 5 wt %, about 2 wt % to about 4 wt. %, about 0.2 wt % to about 1.5 wt %. Other suitable amounts include, for example, 0.01, 0.02, 0.03, 0.04, 0.05, 0.06, 0.07, 0.08, 0.09, 0.1, 0.15, 0.2, 0.25, 0.3, 0.35, 0.4, 0.45, 0.5, 0.55, 0.6, 0.65, 0.7, 0.75, 0.8, 0.85, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 3.1, 3.2, 3.3, 3.4, 3.5, 3.6, 3.7, 3.8, 3.9, 4, 4.1, 4.2, 4.3, 4.4, 4.5, 4.6, 4.7, 4.8, 4.9, and 5 wt %.

For example, the visually contrasting aesthetic particles may have a composition that consists of one or more fatty acids in an amount of about 10 wt. % to about 70 wt. %; a sodium montmorillonite clay in an amount of about 10 wt. % to about 45 wt. %; and a calcium montmorillonite clay in an amount of about 10 wt. % to about 45 wt. %, based on the total weight of fatty acids and clays in the composition. A small amount of color contrasting dye or pigment, e.g., 0.01 to 1 wt. %, based on the total weight of fatty acids and clays in the composition, may be added to achieve a more distinguishable color to the aesthetic particles vs. the color of the laundry detergent composition. Preferably, the composition may be extruded particles having about 40 wt. % to about 70 wt. % fatty acids; about 10 wt. % to about 30 wt. % sodium montmorillonite clay; and about 10 wt. % to about 30 wt. % calcium montmorillonite clay. More preferably, the composition of the aesthetic particles is about 50 wt. % to about 65 wt. % fatty acids; about 15 wt. % to about 25 wt. % sodium montmorillonite clay; and about 15 wt. % to about 25 wt. % calcium montmorillonite clay.

In another embodiment, the composition of the aesthetic particles may include about 25 wt. % to about 60 wt. % fatty acids, 0 wt. % to 20 wt. % preferably about 0.1 wt. % to about 15 wt. %, more preferably about 1 wt. % to about 15 wt. % of polyethylene glycol ether of cetyl alcohol, e.g., TEA-25 ($CH_3(CH_2)_{14}(OCH_2CH_2)_nOH$, where n has an average value of 25); 0 wt. % to about 15 wt. % sodium acetate, preferably about 0.1 wt. % to about 10 wt. %, more preferably about 1 wt. % to about 10 wt. %; 0 wt. % to about 20 wt. %, preferably about 0.1 wt. % to about 15 wt. %, more preferably about 1 wt. % to about 15 wt. % sodium carbonate and/or sodium bicarbonate; about 10 wt. % to about 30 wt. % sodium montmorillonite clay; and about 10 wt. % to about 30 wt. % calcium montmorillonite clay.

The aesthetic particle composition preferably is extruded and cut into discrete particles as the extrudate exits the extruder, preferably having a consistent thickness of about 0.25 mm to about 1.5 mm. Alternatively the extrudate is broken into discrete particles, preferably having a consistent thickness of about 0.25 mm to about 1.5 mm.

The fatty acids may be saturated or unsaturated, $C_6$-$C_{22}$, preferably saturated oleic acid ($C_{18}$), and have 1, 2 or 3 double bonds. It should be understood that fatty acid sources always are a blend containing more than one fatty chain length. The fatty acid(s) may be selected from lauric, myristic, pentadecanoic, palmitic, margaric, stearic, hydroxysteric, isostearic, myristoleic, palmitoleic, oleic, linoleic, linolenic, caprylic, a mixture of caprylic and capric, coconut, hydrogenated coconut, tallow, hydrogenated tallow, soya, arachidic, arachidonic, behenic, capric, caproic, caprylic, corn, cottonseed, menhaden, hydrogenated menhaden, linseed, pelargonic, ricinoleic, tall oil, undecanoic, undecylenic, and mixtures of any two or more of the foregoing fatty acids. In one embodiment, the fatty acid source is sodium oleate soap. Preferably, the fatty acid is predominately unsaturated (more than 50 wt. % based on the total weight of fatty acids) oleic acid that includes one or more of the above listed acids (saturated and/or unsaturated) in minor amount (less than 20-wt. % of the acid blend, preferably less than 10 wt. % of the acid blend).

The sodium smectite clay portion, for example, the sodium montmorillonite clay and/or sodium bentonite clay portion, of the aesthetic particle composition may be mined as sodium smectite clay having sodium as its predominant exchangeable cation, or may initially have another cation, e.g., calcium, or magnesium, or lithium, as its predominant exchangeable cation and, therefore, is ion-exchanged, as well known in the art, to make it a sodium smectite clay—having sodium as its predominant exchangeable cation.

In one embodiment, the sodium smectite clay is included in the composition in a weight percentage approximately equal (within 20%, preferably within 10%) to the weight percentage of the calcium smectite clay. In a preferred embodiment, the composition includes a colorant, and is free of any elastomer.

The visually contrasting aesthetic particle composition preferably includes about 0.001 to about 5 wt %, about 0.1 wt % to about 2.5 wt % about 0.001 to about 0.5 wt %, more preferably 0.1 to 0.3 wt. %, of a colorant (dye and/or pigment) so that it is visually distinguishable from the detergent composition. The color of the visually contrasting aesthetic particles are colored such that they are visually distinguishable from the detergent composition in hue, value (tint or shade) and/or saturation, as known in the art of contrasting colors. Any dye or pigment capable of imparting a visually distinguishable color to the extruded aesthetic particles may be included in the particle composition, preferably prior to extruding. Suitable colorants include food colorants and, preferably, the colorant dyes or pigments are non fabric-substantive. The colorant preferably is red, green, blue, yellow, teal, cyan, brown, orange, violet, purple, or any color that includes one or more of these colorants in combination. White and off-white colorants may be added to provide a visually contrasting color to the aesthetic particles if the detergent composition is sufficiently colored to visually contrast with such a white color. Suitable soap and detergent dyes may be obtained from Chromatech, Incorporated or Chomatech Europe, B.V. as CHROMATINT® colors.

Referring now to the drawing, it has been found that the aesthetic particle composition can be extruded through a die plate having one or more shaped apertures having any desired shape. As shown in the drawing, the extruder 10 includes an auger or extruder screw 12 that conveys the aesthetic particle composition 13 through tunnel 14 toward the die plate 16. Before reaching die plate 16, the aesthetic particle composition fills a void space 18 adjacent to the die plate 16. As more aesthetic composition is forced into the void space 18 to fill the void space 18 with the aesthetic particle composition, the composition pressure against the inner surface of the die plate 16 forces the composition through the shaped die plate openings (not shown). A rotating knife blade 20, cuts the extruded aesthetic particle composition to a desired thickness at each shaped die opening, preferably in the range of about 0.25 mm to about 1.5 mm. By establishing a constant composition pressure in the void space 18, and a consistent timing of a plurality of evenly spread knife blades (arranged like a fan blade) at an outer surface of die plate 16, the production of individual aesthetic particles can be automated to provide thousands of discrete particles having any desired size, shape and thickness, in minutes, from each shaped die plate opening. The cut aesthetic particles can be vacuum removed, as cut, and conveyed by conveyor belt (not shown) for combining with another product, e.g., a powder or granular product, such as a laundry detergent, or for storage.

In an embodiment, the aesthetic particles are in the shape of a ring. For example, in an embodiment, the aesthetic particles can be green in color and ring shaped and include sodium oleate soap in a range of about 55 wt % to about 65 wt %, calcium bentonite in a range of about 15 wt % to about 25 wt %, sodium bentonite in a range of about 15 wt % to about 25 wt %, yellow pigment (for example, Sanolin Tartrazene X90) in a range of about 1 wt % to about 2 wt %, and green pigment (for example, Cosmenyl Green GC) in a range of about 0.1 wt % to about 0.5 wt %. In another embodiment, the aesthetic particles are orange in color and ring shaped and include sodium oleate soap in a range of about 55 wt % to about 65 wt %, calcium bentonite in a range of about 15 wt % to about 25 wt %, sodium bentonite in a range of about 15 wt % to about 25 wt %, orange pigment (for example, Flexonyl Orange SP-G) in a range of about 1 wt % to about 2 wt %.

Detergent Compositions (Before Adding the Aesthetic Particles)

Laundry detergent composition: Typically, the composition is a fully formulated laundry detergent composition, not a portion thereof such as a spray-dried or agglomerated particle that only forms part of the laundry detergent composition. However, it is within the scope of the present invention for an additional rinse additive composition (e.g. fabric conditioner or enhancer), or a main wash additive composition (e.g. bleach additive) to also be used in combination with the laundry detergent composition during the method of the present invention. Although, it may be preferred for no bleach additive composition is used in combination with the laundry detergent composition during the method of the present invention.

Typically, the composition comprises a plurality of chemically different particles, such as spray-dried base detergent particles and/or agglomerated base detergent particles and/or extruded base detergent particles, in combination with one or more, typically two or more, or three or more, or four or more, or five or more, or six or more, or even ten or more particles selected from: surfactant particles, including surfactant agglomerates, surfactant extrudates, surfactant needles, surfactant noodles, surfactant flakes; polymer particles such as cellulosic polymer particles, polyester particles, polyamine particles, terephthalate polymer particles, polyethylene glycol polymer particles; builder particles, such as sodium carbonate and sodium silicate co-builder particles, phosphate particles, zeolite particles, silicate salt particles, carbonate salt particles; filler particles such as sulphate salt particles; dye transfer inhibitor particles; dye fixative particles; bleach particles, such as percarbonate particles, especially coated percarbonate particles, such as percarbonate coated with carbonate salt, sulphate salt, silicate salt, borosilicate salt, or any combination thereof, perborate particles, bleach catalyst particles such as transition metal bleach catalyst particles, or oxaziridinium-based bleach catalyst particles, pre-formed peracid particles, especially coated pre-formed peracid particles, and co-bleach particles of bleach activator, source of hydrogen peroxide and optionally bleach catalyst; bleach activator particles such as oxybenzene sulphonate bleach activator particles and tetra acetyl ethylene diamine bleach activator particles; chelant particles such as chelant agglomerates; hueing dye particles; brightener particles; enzyme particles such as protease prills, lipase prills, cellulase prills, amylase prills, mannanase prills, pectate lyase prills, xyloglucanase prills, bleaching enzyme prills, cutinase prills and co-prills of any of these enzymes; clay particles such as montmorillonite particles or particles of clay and silicone; flocculant particles such as polyethylene oxide particles; wax particles such as wax agglomerates; perfume particles such as perfume microcapsules, especially melamine formaldehyde-based perfume microcapsules, starch encapsulated perfume accord particles, and pro-perfume particles such as Schiff base reaction product particles; aesthetic particles such as coloured noodles or needles or lamellae particles, and soap rings including coloured soap rings; and any combination thereof.

Detergent ingredients: The composition typically comprises detergent ingredients. Suitable detergent ingredients include: detersive surfactants including anionic detersive surfactants, non-ionic detersive surfactants, cationic detersive surfactants, zwitterionic detersive surfactants, amphoteric detersive surfactants, and any combination thereof; polymers including carboxylate polymers, polyethylene glycol polymers, polyester soil release polymers such as terephthalate polymers, amine polymers, cellulosic polymers, dye transfer inhibition polymers, dye lock polymers such as a condensation oligomer produced by condensation of imidazole and epichlorhydrin, optionally in ratio of 1:4:1, hexamethylenediamine derivative polymers, and any combination thereof; builders including zeolites, phosphates, citrate, and any combination thereof; buffers and alkalinity sources including carbonate salts and/or silicate salts; fillers including sulphate salts and bio-filler materials; bleach including bleach activators, sources of available oxygen, pre-formed peracids, bleach catalysts, reducing bleach, and any combination thereof; chelants; photobleach; hueing agents; brighteners; enzymes including proteases, amylases, cellulases, lipases, xylogucanases, pectate lyases, mannanases, bleaching enzymes, cutinases, and any combination thereof; fabric softeners including clay, silicones, quaternary ammonium fabric-softening agents, and any combination thereof; flocculants such as polyethylene oxide; perfume including starch encapsulated perfume accords, perfume microcapsules, perfume loaded zeolites, schif base reaction products of ketone perfume raw materials and polyamines, blooming perfumes, and any combination thereof; aesthetics including soap rings, lamellar aesthetic particles, geltin beads, carbonate and/or sulphate salt speckles, coloured clay, and any combination thereof: and any combination thereof.

Detersive surfactant: The composition typically comprises detersive surfactant. Suitable detersive surfactants include anionic detersive surfactants, non-ionic detersive surfactant, cationic detersive surfactants, zwitterionic detersive surfactants, amphoteric detersive surfactants, and any combination thereof.

Anionic detersive surfactant: Suitable anionic detersive surfactants include sulphate and sulphonate detersive surfactants.

Preferably, the quantity of anionic detersive surfactant is in the range of from 5 to 50% by weight of the total composition. More preferably, the quantity of anionic surfactant is in the range of from about 8% to about 35% by weight.

Suitable sulphonate detersive surfactants include alkyl benzene sulphonate, such as $C_{10-13}$ alkyl benzene sulphonate. Suitable alkyl benzene sulphonate (LAS) is obtainable, or even obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. Another suitable anionic detersive surfactant is alkyl benzene sulphonate that is obtained by DETAL catalyzed process, although other synthesis routes, such as HF, may also be suitable.

Suitable sulphate detersive surfactants include alkyl sulphate, such as $C_{8-18}$ alkyl sulphate, or predominantly $C_{12}$ alkyl sulphate. The alkyl sulphate may be derived from natural sources, such as coco and/or tallow. Alternative, the alkyl sulphate may be derived from synthetic sources such as $C_{12-15}$ alkyl sulphate.

Another suitable sulphate detersive surfactant is alkyl alkoxylated sulphate, such as alkyl ethoxylated sulphate, or a $C_{8-18}$ alkyl alkoxylated sulphate, or a $C_{8-18}$ alkyl ethoxylated sulphate. The alkyl alkoxylated sulphate may have an average degree of alkoxylation of from 0.5 to 20, or from 0.5 to 10. The alkyl alkoxylated sulphate may be a $C_{8-18}$ alkyl ethoxylated sulphate, typically having an average degree of ethoxylation of from 0.5 to 10, or from 0.5 to 7, or from 0.5 to 5 or from 0.5 to 3.

The alkyl sulphate, alkyl alkoxylated sulphate and alkyl benzene sulphonates may be linear or branched, substituted or un-substituted.

The anionic detersive surfactant may be a mid-chain branched anionic detersive surfactant, such as a mid-chain branched alkyl sulphate and/or a mid-chain branched alkyl benzene sulphonate. The mid-chain branches are typically $C_{1-4}$ alkyl groups, such as methyl and/or ethyl groups.

Another suitable anionic detersive surfactant is alkyl ethoxy carboxylate.

The anionic detersive surfactants are typically present in their salt form, typically being complexed with a suitable cation. Suitable counter-ions include $Na^+$ and $K^+$, substituted ammonium such as $C_1$-$C_6$ alkanolammonium such as monoethanolamine (MEA) tri-ethanolamine (TEA), di-ethanolamine (DEA), and any mixture thereof.

Non-ionic detersive surfactant: Suitable non-ionic detersive surfactants are selected from the group consisting of: $C_8$-$C_{18}$ alkyl ethoxylates, such as, NEODOL® non-ionic surfactants from Shell; $C_6$-$C_{12}$ alkyl phenol alkoxylates wherein optionally the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols; $C_{14}$-$C_{22}$ mid-chain branched alkyl alkoxylates, typically having an average degree of alkoxylation of from 1 to 30; alkylpolysaccharides, such as alkylpolyglycosides; polyhydroxy fatty acid amides; ether capped poly(oxyalkylated) alcohol surfactants; and mixtures thereof.

Suitable non-ionic detersive surfactants are alkyl polyglucoside and/or an alkyl alkoxylated alcohol.

Non-ionic detersive surfactant, if present, is preferably used in an amount within the range of from about 1% to about 20% by weight.

Suitable non-ionic detersive surfactants include alkyl alkoxylated alcohols, such as $C_{8-18}$ alkyl alkoxylated alcohol, or a $C_{8-18}$ alkyl ethoxylated alcohol. The alkyl alkoxylated alcohol may have an average degree of alkoxylation of from 0.5 to 50, or from 1 to 30, or from 1 to 20, or from 1 to 10. The alkyl alkoxylated alcohol may be a $C_{8-18}$ alkyl ethoxylated alcohol, typically having an average degree of ethoxylation of from 1 to 10, or from 1 to 7, or from 1 to 5, or from 3 to 7. The alkyl alkoxylated alcohol can be linear or branched, and substituted or un-substituted.

Suitable nonionic detersive surfactants include secondary alcohol-based detersive surfactants having the formula (I):

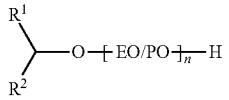

(I)

wherein $R^1$=linear or branched, substituted or unsubstituted, saturated or unsaturated $C_{2-8}$ alkyl;

wherein $R^2$=linear or branched, substituted or unsubstituted, saturated or unsaturated $C_{2-8}$ alkyl, wherein the total number of carbon atoms present in $R^1+R^2$ moieties is in the range of from 7 to 13;

wherein EO/PO are alkoxy moieties selected from ethoxy, propoxy, or mixtures thereof, optionally the EO/PO alkoxyl moieties are in random or block configuration;

wherein n is the average degree of alkoxylation and is in the range of from 4 to 10.

Other suitable non-ionic detersive surfactants include EO/PO block co-polymer surfactants, such as the Plurafac® series of surfactants available from BASF, and sugar-derived surfactants such as alkyl N-methyl glucose amide.

Suitable nonionic detersive surfactants that may be used include the primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic detersive surfactant: Suitable cationic detersive surfactants include alkyl pyridinium compounds, alkyl quaternary ammonium compounds, alkyl quaternary phosphonium compounds, alkyl ternary sulphonium compounds, and mixtures thereof.

Suitable cationic detersive surfactants are quaternary ammonium compounds having the general formula (II):

$$(R)(R_1)(R_2)(R_3)N^+X^- \quad (II)$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, suitable anions include: halides, such as chloride; sulphate; and sulphonate. Suitable cationic detersive surfactants are mono-$C_{6-18}$ alkyl mono-hydroxyethyl di-methyl quaternary ammonium chlorides. Suitable cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Zwitterionic and/or amphoteric detersive surfactant: Suitable zwitterionic and/or amphoteric detersive surfactants include amine oxide such as dodecyldimethylamine N-oxide, alkanolamine sulphobetaines, coco-amidopropyl betaines, $HN^+$—R—$CO_2^-$ based surfactants, wherein R can be any bridging group, such as alkyl, alkoxy, aryl or amino acids. Many suitable detergent active compounds are available and are fully described in the literature, for example, in "Surface-Active Agents and Detergents", Volumes I and II, by Schwartz, Perry and Berch, hereby incorporated by reference.

Polymer: Suitable polymers include carboxylate polymers, polyethylene glycol polymers, polyester soil release polymers such as terephthalate polymers, amine polymers, cellulosic polymers, dye transfer inhibition polymers, dye lock polymers such as a condensation oligomer produced by condensation of imidazole and epichlorhydrin, optionally in ratio of 1:4:1, hexamethylenediamine derivative polymers, and any combination thereof.

Carboxylate polymer: Suitable carboxylate polymers include maleate/acrylate random copolymer or polyacrylate homopolymer. The carboxylate polymer may be a polyacrylate homopolymer having a molecular weight of from 4,000 Da to 9,000 Da, or from 6,000 Da to 9,000 Da. Other suitable carboxylate polymers are co-polymers of maleic acid and acrylic acid, and may have a molecular weight in the range of from 4,000 Da to 90,000 Da.

Polyethylene glycol polymer: Suitable polyethylene glycol polymers include random graft co-polymers comprising: (i) hydrophilic backbone comprising polyethylene glycol; and (ii) hydrophobic side chain(s) selected from the group consisting of: $C_4$-$C_{25}$ alkyl group, polypropylene, polybutylene, vinyl ester of a saturated $C_1$-$C_6$ mono-carboxylic acid, $C_1$-$C_6$ alkyl ester of acrylic or methacrylic acid, and mixtures thereof. Suitable polyethylene glycol polymers have a polyethylene glycol backbone with random grafted polyvinyl acetate side chains. The average molecular weight of the polyethylene glycol backbone can be in the range of from 2,000 Da to 20,000 Da, or from 4,000 Da to 8,000 Da. The molecular weight ratio of the polyethylene glycol backbone to the polyvinyl acetate side chains can be in the range of from 1:1 to 1:5, or from 1:1.2 to 1:2. The average number of graft sites per ethylene oxide units can be less than 1, or less than 0.8, the average number of graft sites per ethylene oxide units can be in the range of from 0.5 to 0.9, or the average number of graft sites per ethylene oxide units can be in the range of from 0.1 to 0.5, or from 0.2 to 0.4. A suitable polyethylene glycol polymer is Sokalan HP22.

Polyester soil release polymers: Suitable polyester soil release polymers have a structure as defined by one of the following structures (III), (IV) or (V):

$$—[(OCHR^1—CHR^2)_a—O—OC—Ar—CO—]_d \quad (III)$$

$$—[(OCHR^3—CHR^4)_b—O—OC\text{-}sAr—CO—]_e \quad (IV)$$

$$—[(OCHR^5—CHR^6)_c—OR^7]_f \quad (V)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is H, Na, Li, K, Mg/2, Ca/2, Al/3, ammonium, mono-, di-, tri-, or tetra-alkylammonium wherein the alkyl groups are $C_1$-$C_{18}$ alkyl or $C_2$-$C_{10}$ hydroxyalkyl, or any mixture thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group. Suitable polyester soil release polymers are terephthalate polymers having the structure (III) or (IV) above.

Suitable polyester soil release polymers include the Repel-o-tex series of polymers such as Repel-o-tex SF2 (Rhodia) and/or the Texcare series of polymers such as Texcare SRA300 (Clariant).

Other suitable soil release polymers may include, for example sulphonated and unsulphonated PET/POET polymers, both end-capped and non-end-capped, and olyethylene glycol/polyvinyl alcohol graft copolymers such as Sokolan (Trade Mark) HP22.

Especially preferred soil release polymers are the sulphonated non-end-capped polyesters described and claimed in WO 95 32997A (Rhodia Chimie), hereby incorporated by reference.

Amine polymer: Suitable amine polymers include polyethylene imine polymers, such as alkoxylated polyalkyleneimines, optionally comprising a polyethylene and/or polypropylene oxide block.

Cellulosic polymer: The composition can comprise cellulosic polymers, such as polymers selected from alkyl cellulose, alkyl alkoxyalkyl cellulose, carboxyalkyl cellulose, alkyl carboxyalkyl, and any combination thereof. Suitable cellulosic polymers are selected from carboxymethyl cellulose, methyl cellulose, methyl hydroxyethyl cellulose, methyl carboxymethyl cellulose, and mixtures thereof. The carboxymethyl cellulose can have a degree of carboxymethyl substitution from 0.5 to 0.9 and a molecular weight from 100,000 Da to 300,000 Da. Another suitable cellulosic polymer is hydrophobically modified carboxymethyl cellulose, such as Finnfix SH-1 (CP Kelco).

Other suitable cellulosic polymers may have a degree of substitution (DS) of from 0.01 to 0.99 and a degree of blockiness (DB) such that either DS+DB is of at least 1.00 or $DB+2DS-DS^2$ is at least 1.20. The substituted cellulosic polymer can have a degree of substitution (DS) of at least 0.55. The substituted cellulosic polymer can have a degree of blockiness (DB) of at least 0.35. The substituted cellulosic polymer can have a DS+DB, of from 1.05 to 2.00. A suitable substituted cellulosic polymer is carboxymethylcellulose.

Another suitable cellulosic polymer is cationically modified hydroxyethyl cellulose.

Random graft co-polymer. Suitable random graft co-polymers typically comprise: (i) from 50 to less than 98 wt % structural units derived from one or more monomers comprising carboxyl groups; (ii) from 1 to less than 49 wt % structural units derived from one or more monomers comprising sulfonate moieties; and (iii) from 1 to 49 wt % structural units derived from one or more types of monomers selected from ether bond-containing monomers represented by formulas (VI) and (VII).

(VI)

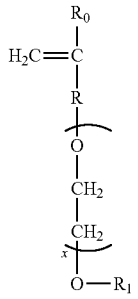

wherein in formula (VI), $R_0$ represents a hydrogen atom or $CH_3$ group, R represents a $CH_2$ group, $CH_2CH_2$ group or single bond, X represents a number 0-5 provided X represents a number 1-5 when R is a single bond, and $R_1$ is a hydrogen atom or $C_1$ to $C_{20}$ organic group.

(VII)

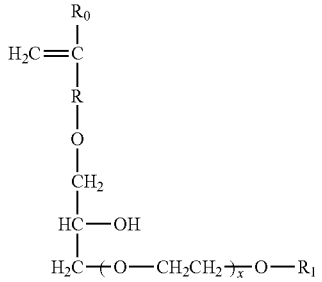

in formula (VII), $R_0$ represents a hydrogen atom or $CH_3$ group, R represents a $CH_2$ group, $CH_2CH_2$ group or single bond, X represents a number 0-5, and $R_1$ is a hydrogen atom or $C_1$ to $C_{20}$ organic group.

Dye transfer inhibitor polymer: Suitable dye transfer inhibitor (DTI) polymers include polyvinyl pyrrolidone (PVP), vinyl co-polymers of pyrrolidone and imidazoline (PVPVI), polyvinyl N-oxide (PVNO), and any mixture thereof.

Hexamethylenediamine derivative polymers: Suitable polymers include hexamethylenediamine derivative polymers, typically having the formula (VIII):

$$R_2(CH_3)N^+(CH_2)6N^+(CH_3)R_2.2X^- \quad \text{(VIII)}$$

wherein $X^-$ is a suitable counter-ion, for example chloride, and R is a poly(ethylene glycol) chain having an average degree of ethoxylation of from 20 to 30. Optionally, the poly(ethylene glycol) chains may be independently capped with sulphate and/or sulphonate groups, typically with the charge being balanced by reducing the number of $X^-$ counter-ions, or (in cases where the average degree of sulphation per molecule is greater than two), introduction of $Y^+$ counter-ions, for example sodium cations.

Builder: Suitable builders include zeolites, phosphates, citrates, and any combination thereof.

Zeolite builder: The composition may be substantially free of zeolite builder. Substantially free of zeolite builder typically means comprises from 0 wt % to 10 wt %, zeolite builder, or to 8 wt %, or to 6 wt %, or to 4 wt %, or to 3 wt %, or to 2 wt %, or even to 1 wt % zeolite builder. Substantially free of zeolite builder preferably means "no deliberately added" zeolite builder. Typical zeolite builders include zeolite A, zeolite P, zeolite MAP, zeolite X and zeolite Y.

Phosphate builder: The composition may be substantially free of phosphate builder. Substantially free of phosphate builder typically means comprises from 0 wt % to 10 wt % phosphate builder, or to 8 wt %, or to 6 wt %, or to 4 wt %, or to 3 wt %, or to 2 wt %, or even to 1 wt % phosphate builder. Substantially free of phosphate builder preferably means "no deliberately added" phosphate builder. A typical phosphate builder is sodium tripolyphosphate (STPP), which may be used in combination with sodium orthophosphate, and/or sodium pyrophosphate.

Other inorganic builders that may be present additionally or alternatively include sodium carbonate, and/or sodium bicarbonate.

Organic builders that may be present include polycarboxylate polymers such as polyacrylates and acrylic/maleic copolymers; polyaspartates; monomeric polycarboxylates such as citrates, gluconates, oxydisuccinates, glycerol mono- di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts.

Citrate: A suitable citrate is sodium citrate. However, citric acid may also be incorporated into the composition, which can form citrate in the wash liquor.

Buffer and alkalinity source: Suitable buffers and alkalinity sources include carbonate salts and/or silicate salts and/or double salts such as burkeitte.

Carbonate salt: A suitable carbonate salt is sodium carbonate and/or sodium bicarbonate. The composition may comprise bicarbonate salt. It may be suitable for the composition to comprise low levels of carbonate salt, for example, it may be suitable for the composition to comprise from 0 wt % to 10 wt % carbonate salt, or to 8 wt %, or to 6 wt %, or to 4 wt %, or to 3 wt %, or to 2 wt %, or even to 1 wt % carbonate salt. The composition may even be substantially free of carbonate salt; substantially free means "no deliberately added".

The carbonate salt may have a weight average mean particle size of from 100 to 500 micrometers. Alternatively, the carbonate salt may have a weight average mean particle size of from 10 to 25 micrometers.

Silicate salt: The composition may comprise from 0 wt % to 20 wt % silicate salt, or to 15 wt %, or to 10 wt %, or to 5 wt %, or to 4 wt %, or even to 2 wt %, and may comprise from above 0 wt %, or from 0.5 wt %, or even from 1 wt % silicate salt. The silicate can be crystalline or amorphous. Suitable crystalline silicates include crystalline layered silicate, such as SKS-6. Other suitable silicates include 1.6R silicate and/or 2.0R silicate. A suitable silicate salt is sodium silicate. Another suitable silicate salt is sodium metasilicate.

Filler: The composition may comprise from 0 wt % to 70% filler. Suitable fillers include sulphate salts and/or bio-filler materials.

Sulphate salt: A suitable sulphate salt is sodium sulphate. The sulphate salt may have a weight average mean particle size of from 100 to 500 micrometers, alternatively, the sulphate salt may have a weight average mean particle size of from 10 to 45 micrometers.

Bio-filler material: A suitable bio-filler material is alkali and/or bleach treated agricultural waste.

Bleach: The composition may comprise bleach. Alternatively, the composition may be substantially free of bleach; substantially free means "no deliberately added". Suitable bleach includes bleach activators, sources of available oxygen, pre-formed peracids, bleach catalysts, reducing bleach, and any combination thereof. If present, the bleach, or any component thereof, for example the pre-formed peracid, may be coated, such as encapsulated, or clathrated, such as with urea or cyclodextrin.

Bleach activator: Suitable bleach activators include: tetraacetylethylenediamine (TAED); oxybenzene sulphonates such as nonanoyl oxybenzene sulphonate (NOBS), caprylamidononanoyl oxybenzene sulphonate (NACA-OBS), 3,5,5-trimethyl hexanoyloxybenzene sulphonate (Iso-NOBS), dodecyl oxybenzene sulphonate (LOBS), and any mixture thereof; caprolactams; pentaacetate glucose (PAG); nitrile quaternary ammonium; imide bleach activators, such as N-nonanoyl-N-methyl acetamide; and any mixture thereof.

Source of available oxygen: A suitable source of available oxygen (AvOx) is a source of hydrogen peroxide, such as percarbonate salts and/or perborate salts, such as sodium percarbonate. The source of peroxygen may be at least partially coated, or even completely coated, by a coating ingredient such as a carbonate salt, a sulphate salt, a silicate salt, borosilicate, or any mixture thereof, including mixed salts thereof. Suitable percarbonate salts can be prepared by a fluid bed process or by a crystallization process. Suitable perborate salts include sodium perborate mono-hydrate (PB1), sodium perborate tetra-hydrate (PB4), and anhydrous sodium perborate which is also known as fizzing sodium perborate. Other suitable sources of AvOx include persulphate, such as oxone. Another suitable source of AvOx is hydrogen peroxide.

Pre-formed peracid: A suitable pre-formed peracid is N,N-pthaloylamino peroxycaproic acid (PAP).

Bleach catalyst: Suitable bleach catalysts include oxaziridinium-based bleach catalysts, transition metal bleach catalysts and bleaching enzymes.

Oxaziridinium-based bleach catalyst: A suitable oxaziridinium-based bleach catalyst has the formula (IX):

(IX)

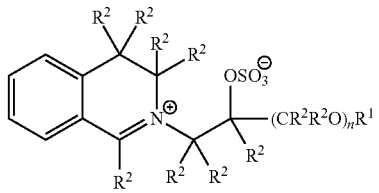

wherein: $R^1$ is selected from the group consisting of: H, a branched alkyl group containing from 3 to 24 carbons, and a linear alkyl group containing from 1 to 24 carbons; $R^1$ can be a branched alkyl group comprising from 6 to 18 carbons, or a linear alkyl group comprising from 5 to 18 carbons, $R^1$ can be selected from the group consisting of: 2-propylheptyl, 2-butyloctyl, 2-pentylnonyl, 2-hexyldecyl, n-hexyl, n-octyl, n-decyl, n-dodecyl, n-tetradecyl, n-hexadecyl, n-octadecyl, iso-nonyl, iso-decyl, iso-tridecyl and iso-pentadecyl; $R^2$ is independently selected from the group consisting of: H, a branched alkyl group comprising from 3 to 12 carbons, and a linear alkyl group comprising from 1 to 12 carbons; optionally $R^2$ is independently selected from the group consisting of H, methyl, a branched alkyl group comprising from 3 to 12 carbons, and a linear alkyl group comprising from 1 to 12 carbons; and n is an integer from 0 to 1. Oxaziridinium-based bleach booster can be produced according to US Patent Publication No. 2006/0089284A1.

Transition metal bleach catalyst: The composition may include transition metal bleach catalyst, typically comprising copper, iron, titanium, ruthenium, tungsten, molybdenum, and/or manganese cations. Suitable transition metal bleach catalysts are manganese-based transition metal bleach catalysts.

Reducing bleach: The composition may comprise a reducing bleach. However, the composition may be substantially free of reducing bleach; substantially free means "no deliberately added". Suitable reducing bleach include sodium sulphite and/or thiourea dioxide (TDO).

Co-bleach particle: The composition may comprise a co-bleach particle. Typically, the co-bleach particle comprises a bleach activator and a source of peroxide. It may be highly suitable for a large amount of bleach activator relative to the source of hydrogen peroxide to be present in the co-bleach particle. The weight ratio of bleach activator to source of hydrogen peroxide present in the co-bleach particle can be at least 0.3:1, or at least 0.6:1, or at least 0.7:1, or at least 0.8:1, or at least 0.9:1, or at least 1.0:1.0, or even at least 1.2:1 or higher.

The co-bleach particle can comprise: (i) bleach activator, such as TAED; and (ii) a source of hydrogen peroxide, such as sodium percarbonate. The bleach activator may at least partially, or even completely, enclose the source of hydrogen peroxide.

The co-bleach particle may comprise a binder. Suitable binders are carboxylate polymers such as polyacrylate polymers, and/or surfactants including non-ionic detersive surfactants and/or anionic detersive surfactants such as linear $C_{11}$-$C_{13}$ alkyl benzene sulphonate.

A bleach stabilizer (heavy metal sequestrant) may also be present. Suitable bleach stabilizers include ethylenediamine tetraacetate (EDTA) and the polyphosphonates such as Dequest®, EDTMP.

Chelant: Suitable chelants are selected from: diethylene triamine pentaacetate, diethylene triamine penta(methyl phosphonic acid), ethylene diamine-N'N'-disuccinic acid, ethylene diamine tetraacetate, ethylene diamine tetra(methylene phosphonic acid), hydroxyethane di(methylene phosphonic acid), and any combination thereof. A suitable chelant is ethylene diamine-N'N'-disuccinic acid (EDDS) and/or hydroxyethane diphosphonic acid (HEDP). The laundry detergent composition may comprise ethylene diamine-N'N'-disuccinic acid or salt thereof. The ethylene diamine-N'N'-disuccinic acid may be in S,S enantiomeric form. The composition may comprise 4,5-dihydroxy-m-benzenedisulfonic acid disodium salt. Suitable chelants may also be calcium crystal growth inhibitors.

Calcium carbonate crystal growth inhibitor: The composition may comprise a calcium carbonate crystal growth inhibitor, such as one selected from the group consisting of: 1-hydroxyethanediphosphonic acid (HEDP) and salts thereof; N,N-dicarboxymethyl-2-aminopentane-1,5-dioic acid and salts thereof; 2-phosphonobutane-1,2,4-tricarboxylic acid and salts thereof; and any combination thereof.

Photobleach: Suitable photobleaches are zinc and/or aluminium sulphonated phthalocyanines.

Brightener. It may be preferred for the composition to comprise fluorescent brighteners such as disodium 4,4'-bis(2-sulfostyryl)biphenyl (C.I. Fluorescent Brightener 351); C.I. Fluorescent Brightener 260, or analogues with its anilino- or morpholino-groups replaced by other groups. Suitable C.I. Fluorescent Brightener 260 may have the following structure (X):

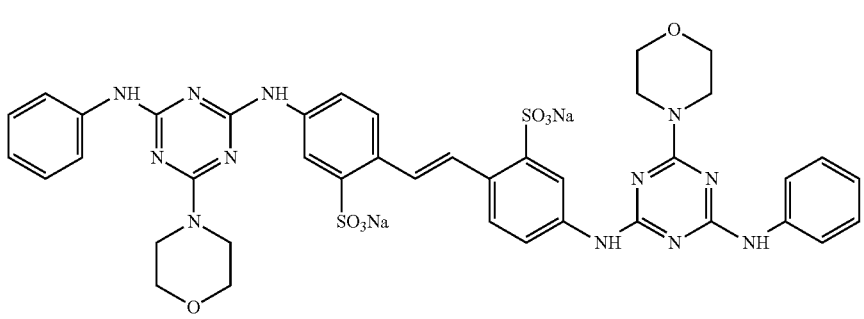

(X)

wherein the C.I. fluorescent brightener 260 is either:

predominantly in alpha-crystalline form; or predominantly in beta-crystalline form and having a weight average primary particle size of from 3 to 30 micrometers.

The composition may preferably comprise bleach-stable fluorescent brighteners such as bis(sulfobenzofuranyl)biphenyl, commercially available from Ciba Specialty Chemicals as Tinopal® PLC.

Hueing agent: The hueing agent (also defined herein as hueing dye) is typically formulated to deposit onto fabrics from the wash liquor so as to improve fabric whiteness perception. The hueing agent is typically blue or violet. It may be suitable that the hueing dye(s) have a peak absorption wavelength of from 550 nm to 650 nm, or from 570 nm to 630 nm. The hueing agent may be a combination of dyes which together have the visual effect on the human eye as a single dye having a peak absorption wavelength on polyester of from 550 nm to 650 nm, or from 570 nm to 630 nm. This may be provided for example by mixing a red and green-blue dye to yield a blue or violet shade.

Dyes are typically coloured organic molecules which are soluble in aqueous media that contain surfactants. Dyes maybe selected from the classes of basic, acid, hydrophobic, direct and polymeric dyes, and dye-conjugates. Suitable polymeric hueing dyes are commercially available, for example from Milliken, Spartanburg, S.C., USA.

Examples of suitable dyes are violet DD, direct violet 7, direct violet 9, direct violet 11, direct violet 26, direct violet 31, direct violet 35, direct violet 40, direct violet 41, direct violet 51, direct violet 66, direct violet 99, acid violet 50, acid blue 9, acid violet 17, acid black 1, acid red 17, acid blue 29, solvent violet 13, disperse violet 27 disperse violet 26, disperse violet 28, disperse violet 63 and disperse violet 77, basic blue 16, basic blue 65, basic blue 66, basic blue 67, basic blue 71, basic blue 159, basic violet 19, basic violet 35, basic violet 38, basic violet 48; basic blue 3, basic blue 75, basic blue 95, basic blue 122, basic blue 124, basic blue 141, thiazolium dyes, reactive blue 19, reactive blue 163, reactive blue 182, reactive blue 96, Liquitint® Violet CT (Milliken, Spartanburg, USA) and Azo-CM-Cellulose (Megazyme, Bray, Republic of Ireland). Other suitable hueing agents are hueing dye-photobleach conjugates, such as the conjugate of sulphonated zinc phthalocyanine with direct violet 99. A particularly suitable hueing agent is a combination of acid red 52 and acid blue 80, or the combination of direct violet 9 and solvent violet 13.

Brightener: Suitable brighteners are stilbenes, such as brightener 15. Other suitable brighteners are hydrophobic brighteners, and brightener 49. The brightener may be in micronized particulate form, having a weight average particle size in the range of from 3 to 30 micrometers, or from 3 micrometers to 20 micrometers, or from 3 to 10 micrometers. The brightener can be alpha or beta crystalline form.

Enzyme: Suitable enzymes include proteases, amylases, cellulases, lipases, xylogucanases, pectate lyases, mannanases, bleaching enzymes, cutinases, and mixtures thereof.

For the enzymes, accession numbers and IDs shown in parentheses refer to the entry numbers in the databases Genbank, EMBL and/or Swiss-Prot. For any mutations, standard 1-letter amino acid codes are used with a * representing a deletion. Accession numbers prefixed with DSM refer to micro-organisms deposited at Deutsche Sammlung von Mikroorganismen and Zellkulturen GmbH, Mascheroder Weg 1b, 38124 Brunswick (DSMZ).

Protease. The composition may comprise a protease. Suitable proteases include metalloproteases and/or serine proteases, including neutral or alkaline microbial serine proteases, such as subtilisins (EC 3.4.21.62). Suitable proteases include those of animal, vegetable or microbial origin. In one aspect, such suitable protease may be of microbial origin. The suitable proteases include chemically or genetically modified mutants of the aforementioned suitable proteases. In one aspect, the suitable protease may be a serine protease, such as an alkaline microbial protease or/and a trypsin-type protease. Examples of suitable neutral or alkaline proteases include:

(a) subtilisins (EC 3.4.21.62), including those derived from *Bacillus*, such as *Bacillus lentus, Bacillus alkalophilus* (P27963, ELYA_BACAO), *Bacillus subtilis, Bacillus amyloliquefaciens* (P00782, SUBT_BACAM), *Bacillus pumilus* (P07518) and *Bacillus* gibsonii (DSM14391).

(b) trypsin-type or chymotrypsin-type proteases, such as trypsin (e.g. of porcine or bovine origin), including the *Fusarium* protease and the chymotrypsin proteases derived from Cellumonas (A2RQE2).

(c) metalloproteases, including those derived from *Bacillus amyloliquefaciens* (P06832, NPRE_BACAM).

Suitable proteases include those derived from *Bacillus* gibsonii or *Bacillus Lentus* such as subtilisin 309 (P29600) and/or DSM 5483 (P29599).

Suitable commercially available protease enzymes include: those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Everlase® and Esperase® by Novozymes A/S (Denmark); those sold under the tradename Maxatase®, Maxacal®, Maxapem®, Properase®, Purafect®, Purafect Prime®, Purafect Ox®, FN3®, FN4®, Excellase® and Purafect OXP® by Genencor International; those sold under the tradename Opticlean® and Optimase® by Solvay Enzymes; those available from Henkel/Kemira, namely BLAP (P29599 having the following mutations S99D+S101 R+S103A+V104I+G159S), and variants thereof including BLAP R (BLAP with S3T+V4I+V199M+V2051+L217D), BLAP X (BLAP with S3T+V4I+V2051) and BLAP F49 (BLAP with S3T+V4I+A194P+V199M+V2051+L217D) all from Henkel/Kemira; and KAP (*Bacillus alkalophilus* subtilisin with mutations A230V+S256G+S259N) from Kao.

In another aspect, suitable proteolytic enzymes (proteases) may be catalytically active protein materials which degrade or alter protein types of stains when present as in fabric stains in a hydrolysis reaction. They may be of any suitable origin, such as vegetable, animal, bacterial or yeast origin. Proteolytic enzymes or proteases of various qualities and origins and having activity in various pH ranges of from 4-12 are available. Proteases of both high and low isoelectric point are suitable.

Amylase: Suitable amylases are alpha-amylases, including those of bacterial or fungal origin. Chemically or genetically modified mutants (variants) are included. A suitable alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, sp 707, DSM 9375, DSM 12368, DSM no. 12649, KSM AP1378, KSM K36 or KSM K38. Suitable amylases include:

(a) alpha-amylase derived from *Bacillus licheniformis* (PO6278, AMY_BACLI), and variants thereof, especially the variants with substitutions in one or more of the following positions: 15, 23, 105, 106, 124, 128, 133, 154, 156, 181, 188, 190, 197, 202, 208, 209, 243, 264, 304, 305, 391, 408, and 444;

(b) AA560 amylase (CBU30457, HD066534) and variants thereof, especially the variants with one or more substitutions in the following positions: 26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484, optionally that also contain the deletions of D183* and G184*;

(c) DSM 12649 having: (a) mutations at one or more of positions 9, 26, 149, 182, 186, 202, 257, 295, 299, 323, 339 and 345; and (b) optionally with one or more, preferably all of the substitutions and/or deletions in the following positions: 118, 183, 184, 195, 320 and 458, which if present preferably comprise R118K, DI83*, GI84*, N195F, R320K and/or R458K; and (d) variants exhibiting at least 90% identity with the wild-type enzyme from *Bacillus* SP722 (CBU30453, HD066526), especially variants with deletions in the 183 and 184 positions.

Suitable commercially available alpha-amylases are Duramyl®, Liquezyme® Termamyl®, Termamyl Ultra®, Natalase®, Supramyl®, Stainzyme®, Stainzyme Plus®, Fungamyl® and BAN® (Novozymes A/S), Bioamylase® and variants thereof (Biocon India Ltd.), Kemzym® AT 9000 (Biozym Ges. m.b.H, Austria), Rapidase®, Purastar®, Optisize HT Plus®, Enzysize®, Powerase® and Purastar Oxam®, Maxamyl® (Genencor International Inc.) and KAM® (KAO, Japan). Suitable amylases are Natalase®, Stainzyme® and Stainzyme Plus®.

Cellulase: The composition may comprise a cellulase. Suitable cellulases include those of bacterial or fungal origin. Chemically modified or protein engineered mutants are included. Suitable cellulases include cellulases from the genera *Bacillus, Pseudomonas, Humicola, Fusarium, Thielavia, Acremonium*, e.g., the fungal cellulases produced from *Humicola insolens, Myceliophthora thermophila* and *Fusarium oxysporum.*

Commercially available cellulases include Celluzyme®, and Carezyme® (Novozymes A/S), Clazinase®, and Puradax HA® (Genencor International Inc.), and KAC-500(B)® (Kao Corporation).

The cellulase can include microbial-derived endoglucanases exhibiting endo-beta-1,4-glucanase activity (E.C. 3.2.1.4), including a bacterial polypeptide endogenous to a member of the genus *Bacillus* sp. AA349 and mixtures thereof. Suitable endoglucanases are sold under the tradenames Celluclean® and Whitezyme® (Novozymes A/S, Bagsvaerd, Denmark).

Suitable cellulases may also exhibit xyloglucanase activity, such as Whitezyme®.

Lipase. The composition may comprise a lipase. Suitable lipases include those of bacterial or fungal origin. Chemically modified or protein engineered mutants are included. Examples of useful lipases include lipases from *Humicola* (synonym *Thermomyces*), e.g., from *H. lanuginosa* (*T. lanuginosus*), or from *H. insolens*, a *Pseudomonas lipase*, e.g., from *P. alcaligenes* or *P. pseudoalcaligenes, P. cepacia, P. stutzeri, P. fluorescens, Pseudomonas* sp. strain SD 705, *P. wisconsinensis*, a *Bacillus lipase*, e.g., from *B. subtilis, B. stearothermophilus* or *B. pumilus.*

The lipase may be a "first cycle lipase", optionally a variant of the wild-type lipase from *Thermomyces lanuginosus* comprising T231R and N233R mutations. The wild-type sequence is the 269 amino acids (amino acids 23-291) of the Swissprot accession number Swiss-Prot 059952 (derived from *Thermomyces lanuginosus* (*Humicola lanuginosa*)). Suitable lipases would include those sold under the tradenames Lipex®, Lipolex® and Lipoclean® by Novozymes, Bagsvaerd, Denmark.

The composition may comprise a variant of *Thermomyces lanuginosa* (059952) lipase having >90% identity with the wild type amino acid and comprising substitution(s) at T231 and/or N233, optionally T231R and/or N233R.

Xyloglucanase: Suitable xyloglucanase enzymes may have enzymatic activity towards both xyloglucan and amorphous cellulose substrates. The enzyme may be a Glycosyl Hydrolase (GH) selected from GH families 5, 12, 44, 45 or 74. The glycosyl hydrolase selected from GH family 44 is particularly suitable. Suitable glycosyl hydrolases from GH family 44 are the XYG1006 glycosyl hydrolase from *Paenibacillus polyxyma* (ATCC 832) and variants thereof.

Also particularly suitable is the glycosyl hydrolase selected from GH family 45 having a molecular weight of from 17 kDa to 30 kDa, for example the endoglucanases sold under the tradename Biotouch® NCD, DCC and DCL (AB Enzymes, Darmstadt, Germany).

Pectate lyase: Suitable pectate lyases are either wild-types or variants of *Bacillus*-derived pectate lyases (CAF05441, AAU25568) sold under the tradenames Pectawash®, Pectaway® and X-Pect® (from Novozymes A/S, Bagsvaerd, Denmark).

Mannanase: Suitable mannanases are sold under the tradenames Mannaway® (from Novozymes A/S, Bagsvaerd, Denmark), and Purabrite® (Genencor International Inc., Palo Alto, Calif.).

Bleaching enzyme: Suitable bleach enzymes include oxidoreductases, for example oxidases such as glucose, choline or carbohydrate oxidases, oxygenases, catalases, peroxidases, like halo-, chloro-, bromo-, lignin-, glucose- or manganese-peroxidases, dioxygenases or laccases (phenoloxidases, polyphenoloxidases). Suitable commercial products are sold under the Guardzyme® and Denilite® ranges from Novozymes. It may be advantageous for additional organic compounds, especially aromatic compounds, to be incorporated with the bleaching enzyme; these compounds interact with the bleaching enzyme to enhance the activity of the oxidoreductase (enhancer) or to facilitate the electron flow (mediator) between the oxidizing enzyme and the stain typically over strongly different redox potentials.

Other suitable bleaching enzymes include perhydrolases, which catalyse the formation of peracids from an ester substrate and peroxygen source. Suitable perhydrolases include variants of the *Mycobacterium smegmatis* perhydrolase, variants of so-called CE-7 perhydrolases, and variants of wild-type subtilisin Carlsberg possessing perhydrolase activity.

Cutinase: Suitable cutinases are defined by E.C. Class 3.1.1.73, optionally displaying at least 90%, or 95%, or most optionally at least 98% identity with a wild-type derived from one of *Fusarium solani, Pseudomonas Mendocina* or *Humicola Insolens*.

Identity. The relativity between two amino acid sequences is described by the parameter "identity". For purposes of the present invention, the alignment of two amino acid sequences is determined by using the Needle program from the EMBOSS package (http://emboss.org) version 2.8.0. The Needle program implements the global alignment algorithm described in Needleman, S. B. and Wunsch, C. D. (1970) J. Mol. Biol. 48, 443-453. The substitution matrix used is BLOSUM62, gap opening penalty is 10, and gap extension penalty is 0.5.

Fabric-softener: Suitable fabric-softening agents include clay, silicone and/or quaternary ammonium compounds. Suitable clays include montmorillonite clay, hectorite clay and/or laponite clay. A suitable clay is montmorillonite clay. Suitable silicones include amino-silicones and/or polydimethylsiloxane (PDMS). A suitable fabric softener is a particle comprising clay and silicone, such as a particle comprising montmorillonite clay and PDMS.

Flocculant: Suitable flocculants include polyethylene oxide; for example having an average molecular weight of from 300,000 Da to 900,000 Da.

Suds suppressor: Suitable suds suppressors include silicone and/or fatty acid such as stearic acid.

Perfume: Suitable perfumes include perfume microcapsules, polymer assisted perfume delivery systems including Schiff base perfume/polymer complexes, starch-encapsulated perfume accords, perfume-loaded zeolites, blooming perfume accords, and any combination thereof. A suitable perfume microcapsule is melamine formaldehyde based, typically comprising perfume that is encapsulated by a shell comprising melamine formaldehyde. It may be highly suitable for such perfume microcapsules to comprise cationic and/or cationic precursor material in the shell, such as polyvinyl formamide (PVF) and/or cationically modified hydroxyethyl cellulose (catHEC).

Other aesthetic: other suitable aesthetic particles may include soap rings, lamellar aesthetic particles, geltin beads, carbonate and/or sulphate salt speckles, coloured clay particles, and any combination thereof.

Method of laundering fabric: The method of laundering fabric typically comprises the step of contacting the composition to water to form a wash liquor, and laundering fabric in said wash liquor, wherein typically the wash liquor has a temperature of above 0° C. to 90° C., or to 60° C., or to 40° C., or to 30° C., or to 20° C., or to 10° C., or even to 8° C. The fabric may be contacted to the water prior to, or after, or simultaneous with, contacting the laundry detergent composition with water. The composition can be used in pre-treatment applications.

Typically, the wash liquor is formed by contacting the laundry detergent to water in such an amount so that the concentration of laundry detergent composition in the wash liquor is from above 0 g/1 to 5 g/l, or from 1 g/l, and to 4.5 g/l, or to 4.0 g/l, or to 3.5 g/l, or to 3.0 g/l, or to 2.5 g/l, or even to 2.0 g/l, or even to 1.5 g/l.

The method of laundering fabric may be carried out in a top-loading or front-loading automatic washing machine, or can be used in a hand-wash laundry application. In these applications, the wash liquor formed and concentration of laundry detergent composition in the wash liquor is that of the main wash cycle. Any input of water during any optional rinsing step(s) is not included when determining the volume of the wash liquor.

The wash liquor may comprise 40 liters or less of water, or 30 liters or less, or 20 liters or less, or 10 liters or less, or 8 liters or less, or even 6 liters or less of water. The wash liquor may comprise from above 0 to 15 liters, or from 2 liters, and to 12 liters, or even to 8 liters of water.

Typically from 0.01 kg to 2 kg of fabric per liter of wash liquor is dosed into said wash liquor. Typically from 0.01 kg, or from 0.05 kg, or from 0.07 kg, or from 0.10 kg, or from 0.15 kg, or from 0.20 kg, or from 0.25 kg fabric per liter of wash liquor is dosed into said wash liquor.

Optionally, 50 g or less, or 45 g or less, or 40 g or less, or 35 g or less, or 30 g or less, or 25 g or less, or 20 g or less, or even 15 g or less, or even 10 g or less of the composition is contacted to water to form the wash liquor.

The laundry detergent compositions also may contain other conventional detergent ingredients.

Antiredeposition agents, for example, cellulose esters and ethers, for example sodium carboxymethyl cellulose, may also be present.

Other ingredients that may be present include solvents, hydrotropes, such as sodium, or calcium cumene sulfonate, potassium napthalenesulfonate, or the like, fluorescers, foam boosters or foam controllers (antifoams) as appropriate, sodium carbonate, sodium bicarbonate, sodium silicate, sodium sulphate, sodium acetate, TEA-25 (polyethylene glycol ether of catylalcohol), calcium chloride, other inorganic salts, flow aids such as silicas and amorphous aluminosilicates, fabric conditioning compounds, clay and soil removal/ antiredeposition agents, other perfumes or pro-perfumes, and combinations of one or more of these cleaning adjuncts.

Powders of low to moderate bulk density may be prepared by spray-drying a slurry, and optionally postdosing (dry-mixing) further ingredients. "Concentrated" or "compact" powders may be prepared by mixing and granulating processes, for example, using a high-speed mixer/granulator, or other non-tower processes. In both types of powder, the visually contrasting bodies may be incorporated by postdosing (dry mixing).

EXAMPLES

The compositions are made by combining the listed ingredients in the listed proportions (weight % of active material except where noted otherwise).

Example 1

Green Ring-Shaped Aesthetic Particle

A green ring-shaped aesthetic particle was formed with the following composition:

| Component | Function | Amount (wt. %) |
|---|---|---|
| Sodium Oleate Soap | Fatty Acid Source | 55-65% |
| Calcium Bentonite Clay | Calcium smectite clay | 15-25% |

-continued

| Component | Function | Amount (wt. %) |
|---|---|---|
| Sodium Bentonite (Activated Calcium) Clay | Sodium smectite clay | 15-25% |
| Sanolin Tartrazene X90 | Yellow pigment | 1-2% |
| Cosmenyl Green GC | Green pigment | 0.1-0.5% |

Orange Ring-Shaped Aesthetic Particle

An orange ring-shaped aesthetic particle was formed with the following composition:

| Component | Function | Amount (wt. %) |
|---|---|---|
| Sodium Oleate Soap | Fatty Acid Source | 55-65% |
| Calcium Bentonite Clay | Calcium smectite clay | 15-25% |
| Sodium Bentonite (Activated Calcium) Clay | Sodium smectite clay | 15-25% |
| Flexonyl Orange SP-G | Orange pigment | 1-2% |

Example 2

Suitable Granular Laundry Detergent Compositions

Granular dry laundry detergent compositions designed for use in washing machines or hand washing processes.

| Ingredient | Amount (in wt %) |
|---|---|
| Anionic detersive surfactant (such as alkyl benzene sulphonate, alkyl ethoxylated sulphate and mixtures thereof) | from 8 wt % to 15 wt % |
| Non-ionic detersive surfactant (such as alkyl ethoxylated alcohol) | from 0.5 wt % to 4 wt % |
| Cationic detersive surfactant (such as quaternary ammonium compounds) | from 0 to 4 wt % |
| Other detersive surfactant (such as zwiterionic detersive surfactants, amphoteric surfactants and mixtures thereof) | from 0 wt % to 4 wt % |
| Carboxylate polymer (such as co-polymers of maleic acid and acrylic acid) | from 1 wt % to 4 wt % |
| Polyethylene glycol polymer (such as a polyethylene glycol polymer comprising poly vinyl acetate side chains) | from 0.5 wt % to 4 wt % |
| Polyester soil release polymer (such as Repel-o-tex and/or Texcare polymers) | from 0.1 to 2 wt % |
| Cellulosic polymer (such as carboxymethyl cellulose, methyl cellulose and combinations thereof) | from 0.5 wt % to 2 wt % |
| Other polymer (such as amine polymers, dye transfer inhibitor polymers, hexamethylenediamine derivative polymers, and mixtures thereof) | from 0 wt % to 4 wt % |
| Zeolite builder and phosphate builder (such as zeolite 4A and/or sodium tripolyphosphate) | from 0 wt % to 4 wt % |
| Other builder (such as sodium citrate and/or citric acid) | from 0 wt % to 3wt % |
| Carbonate salt (such as sodium carbonate and/or sodium bicarbonate) | from 15 wt % to 30 wt % |
| Silicate salt (such as sodium silicate) | from 0 wt % to 10 wt % |
| Filler (such as sodium sulphate and/or bio-fillers) | from 10 wt % to 40 wt % |
| Source of available oxygen (such as sodium percarbonate) | from 10 wt % to 20 wt % |
| Bleach activator (such as tetraacetylethylene diamine (TAED) and/or nonanoyloxybenzenesulphonate (NOBS) | from 2 wt % to 8 wt % |
| Bleach catalyst (such as oxaziridinium-based bleach catalyst and/or transition metal bleach catalyst) | from 0 wt % to 0.1 wt % |
| Other bleach (such as reducing bleach and/or pre-formed peracid) | from 0 wt % to 10 wt % |
| Chelant (such as ethylenediamine-N'N'-disuccinic acid (EDDS) and/or hydroxyethane diphosphonic acid (HEDP) | from 0.2 wt % to 1 wt % |
| Photobleach (such as zinc and/or aluminium sulphonated phthalocyanine) | from 0 wt % to 0.1 wt % |

-continued

| Ingredient | Amount (in wt %) |
|---|---|
| Hueing agent (such as direct violet 99, acid red 52, acid blue 80, direct violet 9, solvent violet 13 and any combination thereof) | from 0 wt % to 1 wt % |
| Brightener (such as brightener 15 and/or brightener 49) | from 0.1 wt % to 0.4 wt % |
| Protease* (such as Savinase ®, Savinase ® Ultra, Purafect ®, FN3, FN4 and any combination thereof) | from 0.1 wt % to 0.4 wt % |
| Amylase* (such as Termamyl ®, Termamyl ® ultra, Natalase ®, Optisize, Stainzyme ®, Stainzyme ® Plus and any combination thereof) | from 0.05 wt % to 0.2 wt % |
| Cellulase* (such as Carezyme ® and/or Celluclean ®) | from 0.05 wt % to 0.2 wt % |
| Lipase* (such as Lipex ®, Lipolex ®, Lipoclean ® and any combination thereof) | from 0.2 to 1 wt % |
| Other enzyme* (such as xyloglucanase, cutinase, pectate lyase, mannanase, bleaching enzyme) | from 0 wt % to 2 wt % |
| Fabric softener (such as montmorillonite clay and/or polydimethylsiloxane (PDMS) | from 0 wt % to 4 wt % |
| Flocculant (such as polyethylene oxide) | from 0 wt % to 1 wt % |
| Suds suppressor (such as silicone and/or fatty acid) | from 0 wt % to 0.1 wt % |
| Perfume (such as perfume microcapsule, spray-on perfume, starch encapsulated perfume accords, perfume loaded zeolite, and any combination thereof) | from 0.1 wt % to 1 wt % |
| Aesthetics (such as visually contrasting aesthetic particles) | from 0.02 wt % to 3 wt % |
| Miscellaneous | balance |

*All enzyme levels expressed as rug active enzyme protein per 100 g detergent composition.

Surfactant ingredients can be obtained from BASF, Ludwigshafen, Germany (Lutensol®); Shell Chemicals, London, UK; Stepan, Northfield, Ill., USA; Huntsman, Huntsman, Salt Lake City, Utah, USA; Clariant, Sulzbach, Germany (Praepagen®).

Sodium tripolyphosphate can be obtained from Rhodia, Paris, France.

Zeolite can be obtained from Industrial Zeolite (UK) Ltd, Grays, Essex, UK.

Citric acid and sodium citrate can be obtained from Jungbunzlauer, Basel, Switzerland.

NOBS is sodium nonanoyloxybenzenesulfonate, supplied by Eastman, Batesville, Ark., USA.

TAED is tetraacetylethylenediamine, supplied under the Peractive® brand name by Clariant GmbH, Sulzbach, Germany.

Sodium carbonate and sodium bicarbonate can be obtained from Solvay, Brussels, Belgium.

Polyacrylate, polyacrylate/maleate copolymers can be obtained from BASF, Ludwigshafen, Germany.

Repel-o-tex can be obtained from Rhodia, Paris, France.

Texcare can be obtained from Clariant, Sulzbach, Germany.

Sodium percarbonate and sodium carbonate can be obtained from Solvay, Houston, Tex., USA.

Na salt of Ethylenediamine-N,N'-disuccinic acid, (S,S) isomer (EDDS) was supplied by Octel, Ellesmere Port, UK.

Hydroxyethane di phosphonate (HEDP) was supplied by Dow Chemical, Midland, Mich., USA.

Enzymes Savinase®, Savinase® Ultra, Stainzyme® Plus, Lipex®, Lipolex®, Lipoclean®, Celluclean®, Carezyme®, Natalase®, Stainzyme®, Stainzyme® Plus, Termamyl®, Termamyl® ultra, and Mannaway® can be obtained from Novozymes, Bagsvaerd, Denmark.

Enzymes Purafect®, FN3, FN4 and Optisize can be obtained from Genencor International Inc., Palo Alto, Calif., US.

Direct violet 9 and 99 can be obtained from BASF DE, Ludwigshafen, Germany.

Solvent violet 13 can be obtained from Ningbo Lixing Chemical Co., Ltd. Ningbo, Zhejiang, China.

Brighteners can be obtained from Ciba Specialty Chemicals, Basel, Switzerland.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A particulate laundry detergent composition comprising a major proportion of detergent particles having a white or colored appearance and a minor proportion of visually contrasting aesthetic particles, the visually contrasting aesthetic particles comprising a colorant, from 55-65 wt % of oleate soap, from 15-25 wt % sodium montmorillonite clay, and from 15-25 wt % of calcium montmorillonite clay, wherein the visually contrasting aesthetic particles leave less than about 5% insoluble residue.

2. A composition as claimed in claim 1, wherein the visually contrasting aesthetic particles are of regular shape.

3. A composition as claimed in claim 1, wherein the visually contrasting aesthetic particles are of uniform size and shape.

4. A composition as claimed in claim 1, wherein the visually contrasting aesthetic particles are of brightly colored material having a distinct contrast from the white or colored detergent particles.

5. A composition as claimed in claim 1, wherein the visually contrasting aesthetic particles are of highly reflective material.

6. A composition as claimed in claim 1, which comprises from 5 to 90% wt % of detergent-active material, from 0 to 80 wt % of detergency builder, from 0.02 to 3 wt % of the visually contrasting aesthetic particles, and optionally other detergent ingredients to 100 wt %.

7. A composition according to claim 1, wherein the composition comprises a detersive surfactant, wherein the detersive surfactant comprises:

(i) alkyl alkoxylated sulphate anionic detersive surfactant having an average degree of alkoxylation of from 0.5 to 5; and/or (ii) predominantly $C_{12}$ alkyl sulphate anionic detersive surfactant; and/or (iii) less than 25% non-ionic detersive surfactant.

8. A composition according to claim 1, wherein the composition comprises a clay and soil removal/anti-redeposition agent selected from the group consisting of:

(a) random graft co-polymers comprising:

(i) hydrophilic backbone comprising polyethylene glycol; and (ii) hydrophobic side chain(s) selected from the group consisting of: $C_4$-$C_{25}$ alkyl group, polypropylene, polybutylene, vinyl ester of a saturated $C_1$-$C_6$ monocarboxylic acid, $C_1$-$C_6$ alkyl ester of acrylic or methacrylic acid, and mixtures thereof;

(b) cellulosic polymers having a degree of substitution (DS) of from 0.01 to 0.99 and a degree of blockiness (DB) such that either DS+DB is of at least 1.00 or DB+2DS-$DS^2$ is at least 1.20;

(c) co-polymers comprising:

(i) from 50 to less than 98 wt % structural units derived from one or more monomers comprising carboxyl groups;

(ii) from 1 to less than 49 wt % structural units derived from one or more monomers comprising sulfonate moieties; and (iii) from 1 to 49 wt % structural units derived from one or more types of monomers selected from ether bond-containing monomers represented by formulas (VI) and (VII):

(VI)

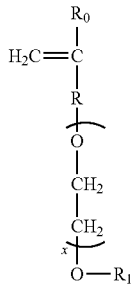

wherein in formula (VI), $R_0$ represents a hydrogen atom or $CH_3$ group, R represents a $CH_2$ group, $CH_2CH_2$ group or single bond, X represents a number 0-5 provided X represents a number 1-5 when R is a single bond, and $R_1$ is a hydrogen atom or $C_1$ to C20 organic group;

(VII)

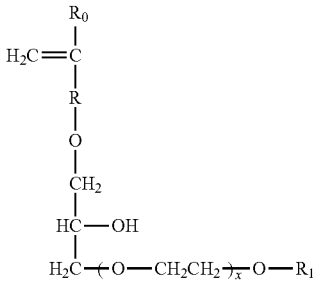

in formula (VII), $R_0$ represents a hydrogen atom or $CH_3$ group, R represents a $CH_2$ group, $CH_2CH_2$ group or single bond, X represents a number 0-5, and $R_1$ is a hydrogen atom or $C_1$ to $C_{20}$ organic group;

(d) polyester soil release polymers having a structure according to one of the following structures (III), (IV) or (V):

$$—[(OCHR1\text{-}CHR2)_a\text{-}O—OC—Ar—CO—]_d \quad (III)$$

$$—[(OCHR3\text{-}CHR4)_b\text{-}O—OC\text{-}sAr—CO—]_e \quad (IV)$$

$$—[(OCHR5\text{-}CHR6)c\text{-}OR7]_f \quad (V)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetra-alkylammonium wherein the alkyl groups are $C_1$-$C_{18}$ alkyl or $C_2$-$C_{10}$ hydroxyalkyl, or any mixture thereof;

R1, R2, R3, R4, R5 and R6 are independently selected from H or $C_1$-$C_{18}$ n- or iso-alkyl; and R7 is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group; and (e) any combination thereof.

9. A composition according to claim 1, wherein the composition comprises an oxaziridinium-based bleach catalyst having the formula (IX):

(IX)

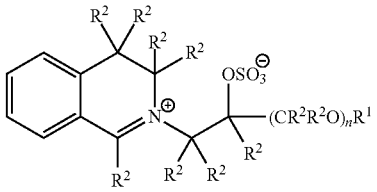

wherein: $R^1$ is selected from the group consisting of: H, a branched alkyl group containing from 3 to 24 carbons, and a linear alkyl group containing from 1 to 24 carbons; $R^2$ is independently selected from the group consisting of: H, a branched alkyl group comprising from 3 to 12 carbons, and a linear alkyl group comprising from 1 to 12 carbons; and n is an integer from 0 to 1.

10. A composition according to claim 1, wherein the composition comprises C.I. fluorescent brightener 260 having the following structure (X):

(X)

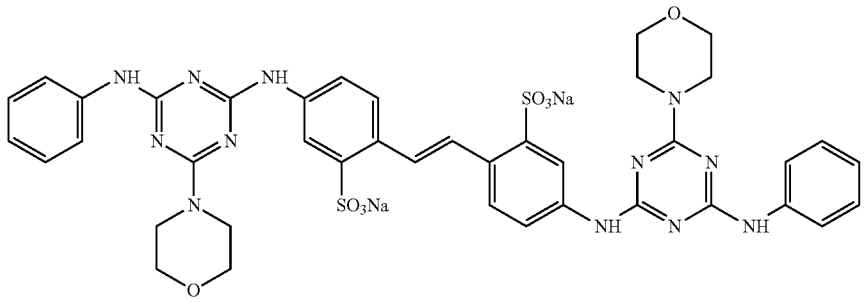

wherein the C.I. fluorescent brightener 260 is either:

predominantly in alpha-crystalline form; or predominantly in beta-crystalline form and having a weight average primary particle size of from 3 to 30 micrometers.

11. A composition according to claim 1, wherein the composition comprises an enzyme selected from the group consisting of:

(a) a variant of *thermomyces lanuginosa* lipase having >90% identity with the wild type amino acid and comprises substitution(s) at T231 and/or N233;

(b) a cleaning cellulase belonging to Glycosyl Hydrolase family 45;

(c) a variant of AA560 alpha amylase endogenous to *Bacillus* sp. DSM 12649 having:

(i) mutations at one or more of positions 9, 26, 149, 182, 186, 202, 257, 295, 299, 323, 339 and 345; and (ii) one or more substitutions and/or deletions in the following positions: 118, 183, 184, 195, 320 and 458; and (d) any combination thereof.

12. A composition according to claim 1, wherein the composition is substantially free of zeolite builder, and wherein the composition is substantially free of phosphate builder.

* * * * *